United States Patent [19]

Nagata et al.

[11] Patent Number: 5,057,165

[45] Date of Patent: Oct. 15, 1991

[54] RARE EARTH PERMANENT MAGNET AND A METHOD FOR MANUFACTURE THEREOF

[75] Inventors: Hiroaki Nagata; Ken Ohashi; Yoshio Tawara; Kenichi Uesaka, all of Fukui, Japan

[73] Assignee: Shin-Etsu Chemical Co., Ltd., Tokyo, Japan

[21] Appl. No.: 558,788

[22] Filed: Jul. 27, 1990

Related U.S. Application Data

[62] Division of Ser. No. 319,408, Mar. 3, 1989, abandoned.

[30] Foreign Application Priority Data

Mar. 4, 1988 [JP] Japan ..... 63-50799

[51] Int. Cl.[5] ..... H01F 41/02

[52] U.S. Cl. ..... 148/102; 148/105; 419/29; 419/31

[58] Field of Search ..... 148/101, 102, 105; 419/29, 31

[56] References Cited

U.S. PATENT DOCUMENTS 4,322,257 3/1982 Menth et al. ..... 148/101

4,734,131 3/1988 Arai et al. ..... 148/102

*Primary Examiner*—R. Dean

*Assistant Examiner*—George Wyszomierski

*Attorney, Agent, or Firm*—McAulay Fisher Nissen Goldberg & Kiel; a

[57] ABSTRACT

A rare earth permanent magnet of a composition, $Ce(CO_{1-x-y-a}Fe_xCu_yM_a)_z$, where a, x, y, and z are: $0.005<1<0.10$; $0.20<x<0.40$; $0.10<y<0.30$; $4.8<z<6.0$; and M is zirconium, titanium, nickel, and/or manganese. A method for manufacturing the magnet is disclosed comprising the steps of: applying a first solid solution heat treatment to an alloy ingot having the above composition at temperatures from 900° to 1100° C. for 10 minutes to 100 hours; pulverizing the alloy ingot; obtaining a magnet body from this pulverized alloy by the powder metallurgy method; sintering the magnet body; applying a second solid solution heat treatment to the sintered magnet body at 900°-100° C. for 10 minutes to 100 hours; and applying aging heat treatment to the sintered magnet.

4 Claims, 2 Drawing Sheets

RARE EARTH PERMANENT MAGNET AND A METHOD FOR MANUFACTURE THEREOF

This is a division of application Ser. No. 07/319,408, filed Mar. 3, 1989, abandoned.

BACKGROUND OF THE INVENTION

1. Field of the Invention

The present invention relates to a rare earth permanent magnet which is useful not only for various electric and electronic devices, but also for motors installed in automotive vehicles. More particularly it relates to a high-performance magnet of the type containing cerium as the rare earth element, with the typical ratio of Ce to other elements being 1:5.

2. Description of the Prior Art

Among numerous kinds of rare earth permanent magnets, Ce-containing magnets and Sm-containing magnets which are basically composed of intermetallic compounds, $CeCo_5$ and $SmCo_5$, respectively, are widely employed. (These are conventionally called 1/5 magnets.) The use of the Sm-containing 1/5 magnets in the fields of electric devices and electronics has sharply increased, despite the fact that these magnets contain expensive samarium and cobalt, because the Sm-containing magnets are capable of exhibiting very high magnetic characteristics. For example, the maximum energy products $(BH)_{max}$ of some Sm-containing 1/5 magnets are about 20 MG.Oe, which is several times as high as those of conventional ferrite and Alnico magnets. A permanent magnet formed from $SmCo_5$ and $Sm_2Co_7$ which has an energy product as high as 15 MG.Oe and up to 20 MG.Oe is disclosed in U.S. Pat. No. 4,075,042.

However, motors for automotive vehicles and domestic electric appliances do not require magnets having a performance as high as a Sm-containing 1/5 magnet. A magnet having a maximum energy product of 10 MG.Oe would be good enough, and therefore the Ce-containing 1/5 magnets are more suitable for those motors. The existing Ce-containing 1/5 magnets, however, are too expensive when compared with non-rare earth permanent magnets used in similar applications. An object of researchers in the field is to reduce the content of expensive cobalt in the Ce-containing magnets without affecting the magnetic properties.

In this regard, the following magnets have been disclosed: (i) $Ce(Co_{0.72}Fe_{0.14}Cu_{0.14})_5$ in "IEEE Trans. Mag Mag", 10,560, (1972); and (ii) $Ce(Co_aCu_bFe_cZr_d)_z$ wherein the content of Fe is from 0.03 to 0.2 in Japanese Kokai (Sho) 62-51484. As can be surmised from these disclosures, a Ce-containing 1/5 magnet fails to maintain the desired magnetic characteristics when its Fe content exceeds 0.2.

However, in the case of Sm-containing magnets, it is known that high magnetic characteristics are maintained even when the Fe content exceeds 0.2 or approaches 0.3 (ref. J. Appl. Phys. 52(3)2517, 1981). These Sm-containing magnets wherein the Fe content is from 0.2 to 0.3 are conventionally called "2/17 magnets" because the ratio of Sm content to the others is roughly 2:17. An object of the present invention is to provide Ce-containing magnets which has high Fe contents and exhibits the desired level of magnetic properties. The Sm-containing 2/17 magnets do not suggest how to do this since the solid solubility of Fe in Sm-containing 2/17 magnets is quite different from that in Ce-containing 1/5 magnets.

Magnets which exhibit a maximum energy product of 10 MG.Oe or higher include NdFeB magnets and SmCo plastic magnets. Although the former contain materials which give rise to high magnetic properties, the stability of its magnetic properties with respect to temperature changes is poor. Also, the existence of neodymium renders the magnet so vulnerable to oxidation (rusting) that it must be coated, and consequently the overall cost becomes as high as that of Sm-containing 2/17 magnets. The SmCo plastic magnet is favored because it can be formed in arbitrary shapes and it needs no finishing treatments such as coating. However, since a magnetic powder containing 90 wt % or more of samarium must be employed, the material cost becomes very high.

SUMMARY OF THE INVENTION

It is therefore an object of the invention to provide a Ce-containing permanent magnet which has magnetic properties comparable to the conventional Ce-containing 1/5 magnets and in which the Co content is substantially reduced. Reducing the content of Co in the existing Ce-containing magnet results in a magnet having poor magnetic properties.

However, the inventors have discovered a rare earth permanent magnet with a decreased Co content and which possesses good magnetic properties whose composition is represented by the formula: $Ce(Co_{1-x-y-a}Fe_xCu_yM_a)_z$ in which a, x, y, and z are numbers falling in the following ranges: $0.005<a<0.10$; $0.2<x<0.4$; $0.10<y<0.30$; $4.8<z<6.0$; and M designates one or more elements selected from zirconium, titanium, nickel, and manganese.

Preferably, in the composition $Ce(Co_{1-x-y-a}Fe_xCu_yM_a)_z$ a, x, y, and z are such that: $0.010\leqq a<0.060$; $0.20<x\leqq 0.30$; $0.15\leqq y\leqq 0.25$; $4.8<z\leqq 5.5$.

The invention also provides a method for manufacturing the rare earth permanent magnet of the above compositions which method comprises steps of: (i) applying a first solid solution heat treatment to an alloy ingot having the above composition at temperatures of from 900° to 1100° C. for a period from 10 minutes to 100 hours; (ii) pulverizing the alloy ingot; (iii) obtaining a magnet body from this pulverized alloy by the powder metallurgy method; (iv) sintering the magnet; (v) applying a second solid solution heat treatment to the sintered magnet at temperatures of from 900° to 1100° C. for a period from 10 minutes to 100 hours; and (vi) applying an aging heat treatment to the sintered magnet.

Preferably, the first and second solid solution heat treatments described above are conducted at temperatures of 900°-1000° C. for a period from one hour to 30 hours.

DESCRIPTION OF THE PREFERRED EMBODIMENT

Figure 1:
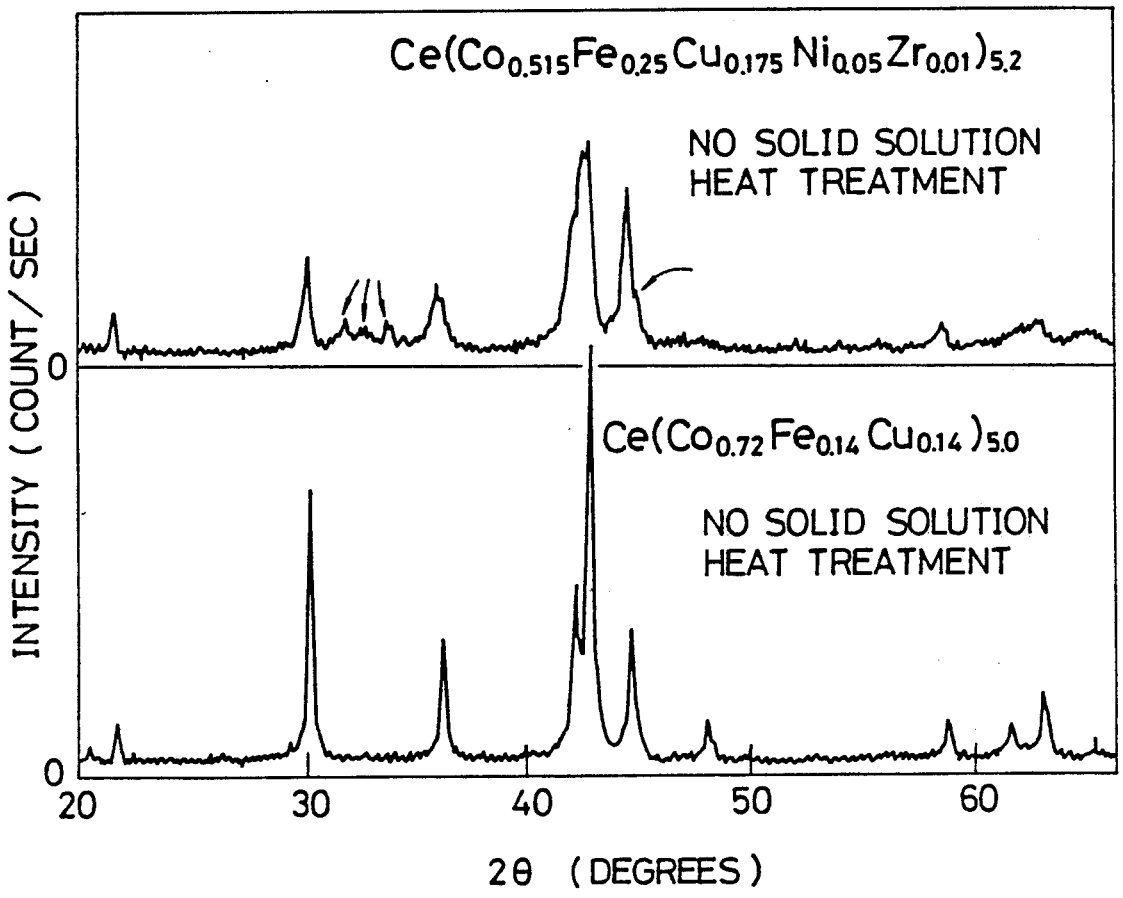
FIG. 1 is a chart showing the X-ray diffraction of an ingot of a composition according to the invention and that of a conventional composition, both without being subjected to solid solution heat treatment.

Since the Fe content accounts for 0.2 to 0.4 molar fraction of the non-cerium elements, i.e., $0.2<x<0.4$, the permanent magnet according to the present invention can be said to be a very iron-rich magnet. If the fraction x is smaller than 0.2, the magnetic properties of the magnet of the invention degrade to the level of the conventional magnets so that the economical merit gained through reduction of the Co content is mostly cancelled. If the fraction x is greater than 0.4, the coercive force (iHc) decreases and the squareness of the magnetic hysteresis loop is largely lost, i.e., the value given by $4Br^{-2}(BH)_{max}$ becomes far smaller than unity, Br being the residual magnetization, such that the magnet cannot be put to practical use.

When the Fe content is high, such as $x>0.2$, a considerable amount of Fe dendrite phase separates in the cast ingot, and such ingots do not make high performance magnets when they are magnetized.

The conventional Ce-containing magnets having comparatively high Fe contents do not exhibit desirous magnetic properties because the Fe dendrite phase existing in the ingot does not orient when the magnet powder is pressed in a magnetic field and the Fe dendrite phase reacts with its surrounding fine powder during sintering thereby affecting the orientation degree of the sintered magnet.

The inventors of the present invention focused their attention on this problem, and discovered they could solve the problem by means of the inventive heat treatment described herein in detail.

The Cu content is restricted such that $0.10<y<0.30$ since if $y<0.1$, the coercive force (iHc) becomes too small and if $y>0.30$, the saturation magnetization ($4\pi Ms$) becomes too low.

In the magnets of the present invention, one or more elements selected from the group of Zr, Ti, Ni, Mn is/are contained, which have the effect of improving the squareness of the magnetic hysteresis loop, i.e., causing the value $4Br^{-2}(BH)_{max}$ to approach unity. These additives (M), however, are not capable of improving the coercive force (iHc) of the Ce-containing magnets unlike the case of the Sm-containing magnets. When the amount of the additive(s) M is such that $a<0.005$, the squareness of the magnetic hysteresis loop is not appreciably improved, and if $a>0.10$, the saturation magnetization is significantly lowered.

As for the ratio of the Ce content to the non-Ce content, when the ratio is such that $z<4.8$ or $6.0<z$, the coercive force and the squareness of the magnetic hysteresis loop are both significantly affected adversely.

The solid solution heat treatment of the invention should be applied twice, first to the ingot form and then to the sintered form. The reason for applying the solid solution heat treatment to the ingot form is to cause the Fe dendrite phase to disappear from the ingot and obtain a uniform 1-5 phase throughout the ingot. The reason for restricting the temperature to effect the solid solution formation to the range of 900° to 1100° C. is that if the temperature is lower than 900° C., the Fe dendrite phase does not disappear, and if the temperature is higher than 1100° C., a phase separates from the 1-5 phase having a melting point lower than that of the 1-5 phase, whereby the magnetic properties are degraded.

If the solid solution heat treatment is conducted for a period shorter than 10 minutes, the Fe dendrite phase does not disappear sufficiently, and if the heat treatment is extended beyond 100 hours, no appreciable metallurgical improvement is obtained after 100 hours and longer heating is economically disadvantageous.

As for the second solid solution heat treatment applied after sintering, since the sintering temperature is 10° to 100° C. higher than the temperature for effecting solid solution formation, a phase of a relatively low melting point separates in the sintered alloy if the Fe content of the alloy is not sufficiently low. Consequently, the formation of the uniform 1-5 phase is not achieved like on the occasion of applying the first solid solution heat treatment to the ingot. Therefore, it is necessary to adopt the same temperature range and the same time range in conducting the second solid solution heat treatment, as the first solid solution heat treatment. If, and only if, these conditions are observed, can one achieve uniform 1-5 phase in the alloy and obtain the desired magnetic properties.

FIG. 1 shows the X-ray diffractions of an alloy ingot of the inventive composition represented by $Ce(Co_{0.51}Fe_{0.25}Cu_{0.175}Ni_{0.05}Zr_{0.01})_{5.2}$, and of an alloy ingot of the composition represented by $Ce(Co_{0.72}Fe_{0.14}Cu_{0.14})_{5.0}$, which belongs to the prior art. As shown, the line width* of the peaks characteristic of the $CaCu_5$ structure exhibited by the alloy of the present invention are larger than those exhibited by the alloy of the prior art. Also, the X-ray diffraction of the alloy of the present invention includes peaks that are foreign to the $CaCu_5$ structure as indicated by the arrows in FIG. 1. Thus, it is necessary to apply a solid solution heat treatment to the alloy ingot of the present invention in order to obtain an alloy ingot having a more consistent $CaCu_5$ structure.

(* A line width of a peak in an X-ray diffraction chart is the width of the peak at the middle height of the peak.)

Figure 2:
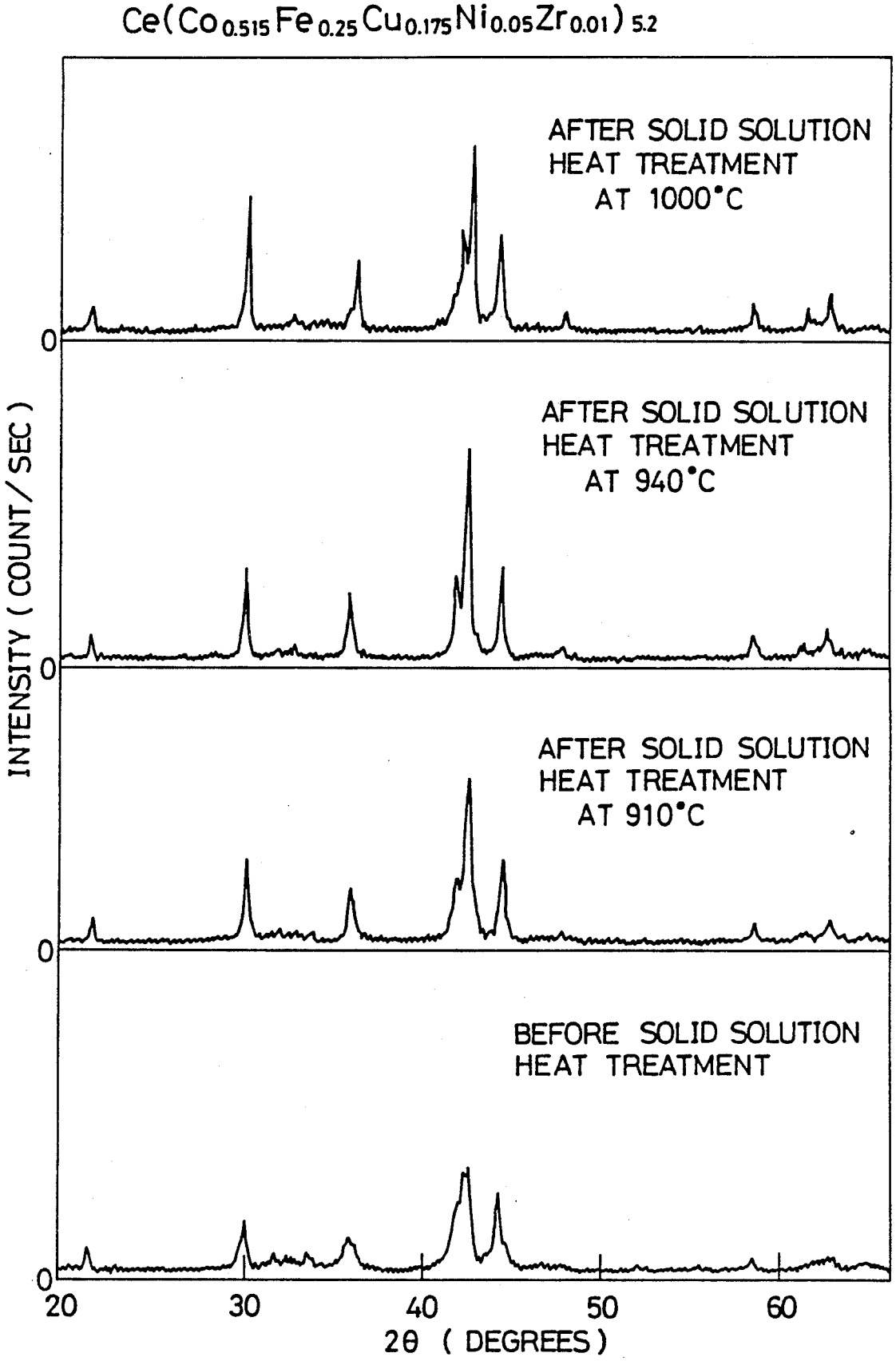
FIG. 2 is a chart showing the X-ray diffractions of the ingot of the same composition according to the invention after the solid solution heat treatment at temperatures 910° C., 940° C., and 1000° C., and that before the solid solution heat treatment.

The upper X-ray diffraction pattern in FIG. 1 is reproduced at the bottom of FIG. 2, for comparison with the X-ray diffractions of the ingot of the same composition of the present invention after the solid solution heat treatment at temperatures at 910° C., 940° C., and 1000° C., respectively. It is seen that as a result of the solid solution heat treatment at these temperatures, the ingot of the invention became purer in $CaCu_5$ structure, which provides the easily magnetizable phase. Of these temperatures, 940° C. is the optimum temperature for this solid solution heat treatment, because the X-ray diffraction obtained after the heat treatment at 940° C. is the one most akin to the diffraction pattern attributable to the $CaCu_5$ structure.

Therefore, according to the invention, it is possible to obtain a Co-lean, Ce-containing magnet which has magnetic properties comparable to or even better than the conventional Ce-containing magnet with a Co content of 50% or greater, by replacing much of cobalt with less expensive iron and applying the inventive solid solution heat treatment to the magnet alloy.

EXAMPLE 1

A magnet in the form of an ingot having the composition of $Ce(Co_{0.53}Fe_{0.25}Cu_{0.18}Ni_{0.03}Ti_{0.01})_{5.5}$ was prepared. The contents of Co and Fe were 37.0 wt % and 16.6 wt %, respectively. See No. 1 (a) in Table 1. The additives were Ni and Ti. This ingot was melted in an argon atmosphere of 1 atm by induction heating and a magnetic ingot was obtained. Next, this ingot was placed in a sintering furnace and was subjected to solid solution heat treatment in an argon atmosphere of 200 Torr at 920° C. which lasted for 20 hours. As a result, the Fe dendrite phase disappeared and a uniform 1-5 phase was obtained. Next, this ingot was pulverized and reformed into a magnet by means of the powder metallurgy method using the following procedures. First, the ingot was roughly pulverized by a crusher (a jaw crusher and a Brown mill), then the crushed fragments were finely pulverized to a mean particle diameter of 3 μm by a nitrogen gas jet mill.

This fine powder was oriented in a static magnet field of 10 kOe, and pressed under a pressure of 2 t/cm$^2$. The compact was sintered in the sintering furnace for one hour at a temperature of 1020° C. in an argon atmosphere of 200 Torr. After the sintering the sintered body was subjected to a second solid solution heat treatment at 990° C. which lasted two hours. This caused the phase of lower melting point, which separated during the sintering operation, to disappear and become an integral part of the uniform 1-5 phase again. Thereafter, the magnet body was subjected to an aging heat treatment at 500° C. in an argon atmosphere of 1 atm, and a permanent magnet having the properties as shown in No. 1 (a) in Table 1 was obtained.

For the sake of comparison, a magnet of the same composition was made in the same manner as the magnet of No. 1 (a) except that the first and second solid solution heat treatments were not applied. The magnetic properties of the resulting magnet are shown at No. 1 (b) in Table 1. The No. 1 (b) magnet exhibits poorer magnetic properties in all of aspects shown in the Table 1, for the apparent reason that the uniform 1-5 phase failed to develop exclusively, and as a result, much of the squareness of the magnetic hysteresis loop was lost.

EXAMPLE 2

A magnet in the form of an ingot having the composition of $Ce(Co_{0.58}Fe_{0.25}Cu_{0.16}Zr_{0.01})_{5.2}$ was prepared. The contents of Co and Fe were 39.7 wt % and 16.2 wt %, respectively. See No. 2 (a) in Table 1. Zirconium was the only additive. This ingot was processed in the same manner as in Example 1 except that the ingot was subjected to the first solid solution heat treatment at 960° C. for ten hours. As a result, a permanent magnet having the properties as shown in No. 2 (a) in Table 1 was obtained.

For the sake of comparison, a magnet of the same composition was made in the same manner as the magnet of No. 2 (a) except that the first and second solid solution heat treatments were not applied. The magnetic properties of the resulting magnet are shown at No. 2 (b) in Table 1. The No. 2 (b) magnet exhibits poorer magnetic properties in all aspects since the uniform 1-5 phase failed to develop exclusively, and consequently, the squareness of the magnetic hysteresis loop was much lost.

EXAMPLE 3

A magnet in the form of an ingot having the composition of $Ce(Co_{0.515}Fe_{0.25}Cu_{0.175}Ni_{0.05}Zr_{0.01})_{5.2}$ was prepared. The contents of Co and Fe were 35.2 wt % and 16.2 wt %, respectively. See No. 3 (a) in Table 1. The additives were nickel and zirconium. This ingot was processed in the same manner as in Example 1 except for the following details. The ingot was subjected to the first solid solution heat treatment at 960° C. for four hours. The compact was sintered for one hour at 1010° C. After sintering, the solid solution heat treatment was conducted at 950° C. for three hours. The temperature for the aging heat treatment was controlled to 550° C. As a result, a permanent magnet having the properties as shown in No. 3 (a) in Table 1 was obtained.

For the sake of comparison, a magnet of the same composition was made in the same manner as the magnet of No. 3 (a) except that the first solid solution heat treatment was not applied. The magnetic properties of the resulting magnet are shown at No. 3 (b) in Table 1. The No. 3 (b) magnet exhibits poorer magnetic properties in all aspects, although the squareness of the magnetic hysteresis loop was not as bad as No. 1 (b) and No. 2 (b) magnets. It is therefore clear that the first solid solution heat treatment applied to the ingot is essential.

EXAMPLE 4

A magnet in the form of an ingot having the composition of $Ce(Co_{0.44}Fe_{0.30}Cu_{0.20}Ni_{0.05}Zr_{0.01})_{5.3}$ was prepared. The contents of Co and Fe were 30.3 wt % and 19.6 wt %, respectively. See No. 4 (a) in Table 1. The additives were nickel and zirconium. This ingot was processed in the same manner as in Example 1 except for the following details. The ingot was subjected to the first solid solution heat treatment at 980° C. for ten hours. After sintering, the second solid solution heat treatment was conducted at 930° C. for four hours. The temperature for the aging heat treatment was controlled to 550° C. As a result, a permanent magnet having the properties as shown in No. 4 (a) in Table 1 was obtained.

For the sake of comparison, a magnet of the same composition was made in the same manner as the magnet of No. 4 (a) except that the second solid solution heat treatment was not applied. The magnetic properties of the resulting magnet are shown at No. 4 (b) in Table 1. The No. 4 (b) magnet exhibits poorer magnetic properties in all aspects but the residual magnetization, or remanence, (Br). The squareness of the magnetic hysteresis loop was even worse than that of No. 3 (b) and it is clear that the second solid solution heat treatment applied after the sintering is essential too.

EXAMPLE 5

A magnet in the form of an ingot having the composition of $Ce(Co_{0.41}Fe_{0.35}Cu_{0.20}Mn_{0.03}Zr_{0.01})_{5.5}$ was prepared. The contents of Co and Fe were 28.6 wt % and 23.1 wt %, respectively. See No. 5 in Table 1. The additives were manganese and zirconium. This ingot was processed in the same manner as in Example 1 except for the following details. The ingot was subjected to the first solid solution heat treatment at 990° C. for twenty hours. The compact was sintered for two hours at 1030° C. After sintering, the second solid solution heat treatment was conducted at 970° C. for ten hours. The temperature for the aging heat treatment was controlled to 600° C. As a result, a permanent magnet having the properties as shown in No. 5 in Table 1 was obtained. It is noted that the iron content is as high as 23.1 wt %, and that the residual magnetization is quite high.

COMPARATIVE EXAMPLE 1

By way of a comparative example, a magnet in the form of an ingot having the composition of $Ce(Co_{0.45}Fe_{0.30}Cu_{0.25})_{5.5}$ was prepared. The contents of Co and Fe were 31.3 wt % and 19.8 wt %, respectively. See No. 7 in Table 2. No additives were used, and therefore the composition is outside the scope of the invention. This ingot was melted in an argon atmosphere of 1 atm by induction heating and a magnetic ingot was obtained. Next, this ingot was placed in a sintering furnace and was subjected to solid solution heat treatment in an argon atmosphere of 200 Torr at 980° C. which lasted for 10 hours. Next, this ingot was pulverized and reformed into a magnet by means of the powder metallurgy method using the following procedures. First, the ingot was roughly pulverized by a crusher (a jaw crusher and a Brown mill), then the crushed fragments were finely pulverized to a mean particle diameter of 3 μm by a nitrogen gas jet mill. This fine powder was oriented in a static magnet field, and pressed under a pressure of 2 t/cm$^2$. The compact was sintered in the sintering furnace for two hours at a temperature of 1030° C. in an argon atmosphere of 200 Torr. After the sintering the sintered body was subjected to a second solid solution heat treatment at 950° C. which lasted four hours. Thereafter, the magnet body was subjected to an aging heat treatment at 550° C. in an argon atmosphere of 1 atm, and a permanent magnet having the properties as shown in No. 7 in Table 2 was obtained.

Containing no additives, the magnet of this composition exhibits a low squareness of the magnetic hysteresis loop compared with Examples 1 through 5, and the magnetic properties are also low.

COMPARATIVE EXAMPLE 2

By way of a comparative example, a magnet in the form of an ingot having the composition of $Ce(Co_{0.31}Fe_{0.45}Cu_{0.20}Mn_{0.03}Zr_{0.01})_{5.0}$ was prepared. The contents of Co and Fe were 21.1 wt % and 29.0 wt %, respectively. See No. 6 in Table 2. The additives used were Mn and Zr like Example 5, and the fraction x of Fe content is as high as 0.45 and thus the composition is outside the scope of the invention. This ingot was processed in the same manner as in Comparative Example 2 except that the first solid solution heat treatment was conducted at 980° C. for 30 hours. The compact obtained after the powder metallurgy was sintered at 1020° C. for two hours. After the sintering the sintered body was subjected to a second solid solution heat treatment at 970° C. for twenty hours. The subsequent aging heat treatment was conducted at 620° C., and a permanent magnet having the properties as shown in No. 6 in Table 2 was obtained.

Since the Fe content is as high as 29.0 wt %, the coercive force iHc was very low even though the additives were used.

TABLE 1

| | | Br (kG) | iHc (kOe) | $(BH)_{max}$ (MG.Oe) | squareness | first solid solution heat treatment done? | second solid solution heat treatment done? | Co (wt %) | Fe (wt %) |
|---|---|---|---|---|---|---|---|---|---|
| No. 1 | (a) | 7.0 | 6.0 | 11 | 0.90 | yes | yes | 37.0 | 16.6 |
| | (b) | 6.7 | 4.0 | 5 | 0.45 | no | no | | |
| No. 2 | (a) | 7.2 | 6.3 | 12.5 | 0.95 | yes | yes | 39.7 | 16.2 |
| | (b) | 7.0 | 4.5 | 6 | 0.49 | no | no | | |
| No. 3 | (a) | 7.0 | 6.5 | 12 | 0.95 | yes | yes | 35.2 | 16.2 |
| | (b) | 6.8 | 6.0 | 9 | 0.78 | no | yes | | |
| No. 4 | (a) | 7.8 | 5.0 | 14 | 0.92 | yes | yes | 30.3 | 19.6 |
| | (b) | 7.8 | 3.5 | 10 | 0.66 | yes | no | | |
| No. 5 | | 8.3 | 4.5 | 15 | 0.87 | yes | yes | 28.6 | 23.1 |

TABLE 2

(COMPARATIVE EXAMPLES)

| | Br (kG) | iHc (kOe) | $(BH)_{max}$ (MG.Oe) | squareness | first solid solution heat treatment done? | second solid solution heat treatment done? | Co (wt %) | Fe (wt %) |
|---|---|---|---|---|---|---|---|---|
| No. 6 | 8.6 | 0.5 | 3 | 0.16 | yes | yes | 21.1 | 29.0 |
| No. 7 | 7.8 | 4.5 | 8 | 0.53 | yes | yes | 31.3 | 19.8 |

What is claimed is:

1. A method for manufacturing a rare earth permanent magnet comprising the steps of:
   (i) applying a first solid solution heat treatment to an alloy ingot having the composition represented by the formula: $Ce(Co_{1-x-y-a}Fe_xCu_yM_a)_z$, wherein a, x, y, and z represent numbers such that: $0.005<a<0.100$; $0.20<x<0.40$; $0.10<y<0.30$; $4.8<z<6.0$; and M designates an element selected from the group consisting of zirconium, titanium, nickel, manganese and combinations thereof; at temperatures of 900°-1100° C. for a period from 10 minutes to 100 hours;
   (ii) pulverizing the alloy ingot;
   (iii) producing a magnet body from this pulverized alloy by:
      a) orienting the pulverized alloy in a magnetic field; and
      b) pressing the oriented alloy into a compact to form a magnet;
   (iv) sintering the magnet;
   (v) applying a second solid solution heat treatment to the sintered magnet at temperatures 900°-1100° C. for a period from 10 minutes to 100 hours; and
   (vi) applying an aging heat treatment to the sintered magnet.

2. A method of claim 1, wherein a, x, y, and z are such that: $0.010\leqq a<0.060$; $0.20<x\leqq 0.30$; $0.15\leqq y\leqq 0.25$; $4.8<z\leqq 5.5$.

3. A method of claim 1, wherein said first and second solid solution heat treatments are conducted at temperatures of 900°-1000° C. for a period from one hour to 30 hours.

4. A method of claim 1, wherein a, x, y, and z are such that: $0.010\leqq a<0.060$; $0.20<x\leqq 0.30$; $0.15\leqq y\leqq 0.25$; $4.8<z\leqq 5.5$; and wherein said first and second solid solution heat treatments are conducted at temperatures of 900°-1000° C. for a period from one hour to 30 hours.

* * * * *